United States Patent [19]

Winkler et al.

[11] Patent Number: 4,480,529

[45] Date of Patent: Nov. 6, 1984

[54] AXIAL PISTON PUMP

[75] Inventors: Ottmar Winkler, Schweinfurt; Egon Pfaller, Dittelbrunn, both of Fed. Rep. of Germany

[73] Assignee: SKF Kugellagerfabriken GmbH, Schweinfurt, Fed. Rep. of Germany

[21] Appl. No.: 289,206

[22] Filed: Aug. 3, 1981

[30] Foreign Application Priority Data

Aug. 9, 1980 [DE] Fed. Rep. of Germany ..... 3030285

[51] Int. Cl.[3] ..... F01B 3/04

[52] U.S. Cl. ..... 92/31; 92/33; 92/165 PR; 417/534

[58] Field of Search ..... 74/56, 57; 92/31, 33, 92/165 PR, 255; 417/534

[56] References Cited

U.S. PATENT DOCUMENTS

| | | | |
|---|---|---|---|
| 1,229,009 | 6/1917 | Allison | 92/138 |
| 2,176,300 | 10/1939 | Fette | 92/138 |
| 3,388,603 | 6/1968 | Clark | 92/33 |
| 3,477,345 | 11/1969 | Johnson | 92/31 |
| 3,499,342 | 3/1970 | Ligh | 92/33 |
| 4,196,654 | 4/1980 | Stearns | 92/33 |
| 4,358,881 | 11/1982 | Mahrus et al. | 92/223 |

FOREIGN PATENT DOCUMENTS

| | | | |
|---|---|---|---|
| 7324573 | 1/1975 | France | 92/33 |

*Primary Examiner*—Robert E. Garrett
*Assistant Examiner*—Richard S. Meyer
*Attorney, Agent, or Firm*—Eugene E. Renz, Jr.

[57] ABSTRACT

A piston pump assembly comprising a housing, a piston member mounted for axial movement in a bore of the said housing forming a piston chamber, and arranged coaxially relative to a drive shaft, said piston comprising a thin-walled member of generally cup shaped configuration, cam means associated with said drive shaft disposed in the recess of said cup shaped piston and cam follower means associated with said piston operatively connected to said cam means whereby rotation of said shaft effects through said cam and cam follower means axial back and forth movement of said piston in said piston chamber.

13 Claims, 7 Drawing Figures

AXIAL PISTON PUMP

BACKGROUND AND SUMMARY OF THE INVENTION

The present invention relates to piston pumps and specifically those incorporating a piston which reciprocates in a chamber of cylindrical housing and is disposed coaxially relative to a drive shaft. The piston has a cam surface which is in operative engagement with at least one cam projection having a complementary cam surface connected with the drive shaft and rotating with it.

Piston pumps of this general construction are not new, per se. A typical prior art axial piston pump is shown in German Pat. No. 1,299,189 and in this assembly, the cam surface is arranged on the back side of the piston and is formed of an integral solid material. In these assemblies, the piston is very heavy and therefore has a high mass to accelerate. Additionally, the entire pump is rather elongated in an axial direction. The axial construction length is even further increased in the known constructions by reason of the fact that planetary running rolling elements are disposed between the cam surfaces of the piston and the drive shaft.

Another prior art pump assembly is shown in German published application No. 2,646,340. There is disclosed additionally a vacuum pump with an immediate drive of the pump of a dynamo in which the free end of the shaft of the dynamo has a bent portion and the eccentricity of this bent portion provides the stroke for a piston member of the vacuum pump. The bent portion carries a ball bearing, wherein the outer ring is designed to cooperate with a pressure disc of the piston member. The piston member is in the form of an elastic membrane which limits the stroke of the piston to only one per drive shaft rotation and therefore this type of pump has only a comparatively small forwarding capacity. Furthermore, the bent portion must be produced and machined and is relatively expensive.

With the foregoing in mind, it is an object of the present invention to provide a piston pump of the above mentioned general type which consists of economically and relatively easy to produce components and is compact and space saving at a high capacity. This is achieved in accordance with the present invention by a piston construction consisting of a single or multi component thin-walled cup closed off at one end wherein the cam surface of the piston is arranged inside the center recess of the cup. In its simplest form, the piston assembly of the present invention consists of a single cup closed off on one side which is generally pot shaped. Alternatively, the piston assembly may comprise plural elements consisting of one cup and two thin-walled sleeves arranged axially next to one another in the bore of the cup. In order to form the piston surface, either the cup itself is closed off on one side or in a cylindrical construction of the cup open on both sides, at least one of the sleeves is closed off at one side, that is, one sleeve is provided with a bottom.

The cam surface or cam follower of the piston in accordance with the present invention can be formed by a radially inwardly directed tab which is preferrably formed integrally with the sleeve shaped section of the piston as a bent in radially inwardly directed portion. In a multi-component form of the piston, it is advantageous to provide the pair of thin-walled sleeves disposed axially next to one another in the bore of the cup each with at least one radially inwardly directed tab which forms an axial space therebetween within which engages the edge of the cam disc carrying the cam surfaces rotating with the drive shaft. In a preferred form of the multi-component construction, each of the sleeves preferrably has two diametrically opposed tabs.

A piston constructed in accordance with the present invention can be comprised of components which can be simply and economically produced without machining in a deep drawing process. This piston assembly is lightweight and occupies comparatively little space by reason of the thin-walled thickness of the components. A lightweight piston is especially advantageous to minimize capacity losses of the drive. Furthermore, by reason of this construction, the two sleeves inserted in the cup housing forming the piston may be shaped identically which further reduces tooling costs and substantially simplifies the bearing support of the individual components. Additionally, the tabs forming the cam surface or cam follower of the piston can be simply punched without machining, bent or bent over, so that the machining step or special shaping of the starting material is not necessary.

In accordance with another feature of the present invention, the tabs are shaped so that they are arcuate or curved in a peripheral direction of the cam disc and in this manner form lubricant pockets between the tabs and the corresponding surfaces of the cam disc which reduces friction and wear of the components engaging or sliding on one another. It is also possible to reduce friction in accordance with a preferred embodiment of the invention by coating the tabs and/or the cam surfaces of the cam disc with a layer of low friction material.

In accordance with another feature of the present invention, rather simplified means are provided to secure the piston against rotating movement in relation to the cylindrical housing by providing either the piston at the outer peripheral surface or the bore of the cylindrical housing with at least one radial projection and the bore of the cylinder or the outside surface of the piston with a complementary corresponding recess forming a pocket for a radial projection which engages in the recess in a manner to permit relative axial movement between the piston and the cylindrical housing and restrict rotational movement. Alternatively, the outer peripheral surface of the piston and the corresponding bore of the cylinder may be provided with complementary recesses for rolling elements which serve the same purpose, that is, to permit axial movement of the piston in the housing but restrict rotational movement.

In lieu of the above, since the piston may be formed in a deep drawing process so that it can easily be formed to various non-circular shapes and also since the cylinder bore is machined by reaming, the piston may be secured against rotation by forming it of a non-circular shape, for example, the shape of an ellipse. The cylinder bore also may be formed of a complementary non-circular shape to achieve the desired non-rotation of the piston in the bore of the cylinder.

While the principal embodiment of the invention illustrated is a single acting piston assembly, the principle of the present invention has equal application to double acting assemblies wherein the second stroke volume is defined by the inner front face of the cup like piston. However, since the smallest possible stroke volume cannot be attained in this way, it is proposed according to another feature of the present invention to locate the position of the open rim of the cup radially inwardly up to the area of the drive shaft of the cam disc or to design the sleeve on the side of the drive shaft of the cam disc with a bottom having a suitable opening for the drive shaft. In accordance with this design, the unavoidable gap between the drive shaft, the annular projection of the cam disc and the inside edge of the shifted rim, a suitable seal is provided in the opening in the bottom of the cup. It is also advantageous to seal the stroke volume against the housing wall penetrated by the drive shaft of the cam disc.

DESCRIPTION OF THE DRAWING

These and other objects of the present invention and various features and details of the operation and construction thereof are hereinafter more fully set forth with reference to the accompanying drawings, wherein.

DESCRIPTION OF THE PREFERRED EMBODIMENT

Figure 1:
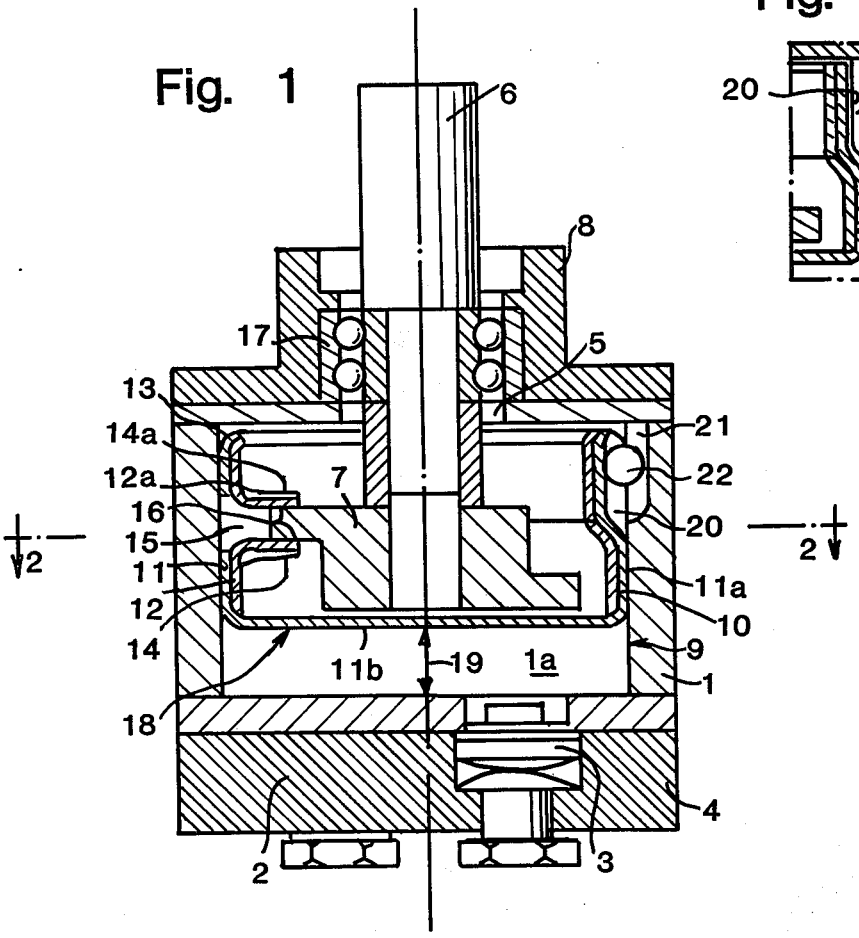
FIG. 1 is a longitudinal sectional view taken on lines 1—1 of FIG. 2 of an axial piston pump in accordance with the present invention.
Figure 2:
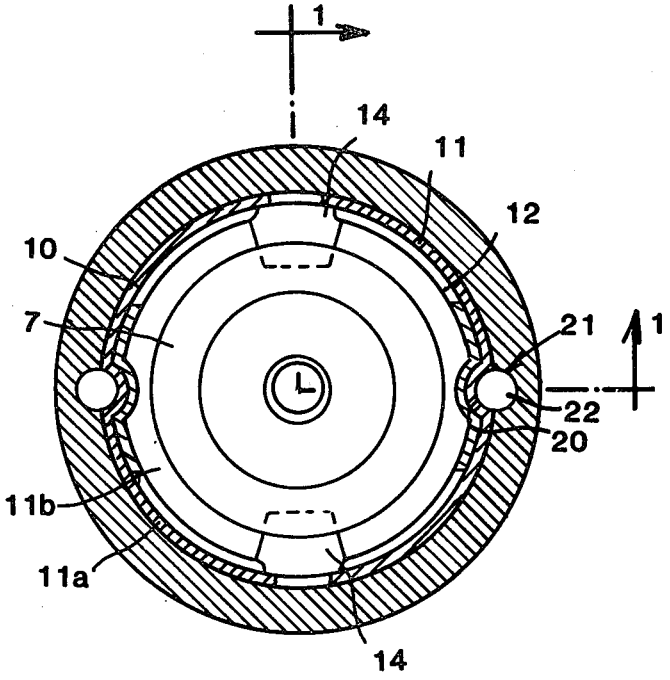
FIG. 2 is a sectional view taken on lines 2—2 of FIG. 1.

Referring now to the drawings and particularly to FIGS. 1 and 2 thereof, there is illustrated a pump assembly in accordance with the present invention. The pump assembly comprises a housing consisting of an elongated cylindrical hollow tubular member 1 closed at opposite axial ends by disc-like covers 4 and 8 defining a piston chamber $1^a$. The cover 8 has a central opening 5 to accommodate the drive shaft 6 for a cam disc 7. A piston member 10 is disposed coaxially of the drive shaft and adapted for reciprocating axial back and forth movement in the bore 9 of the cylinder 1. Conventional intake and outlet valve 2 and 3 respectively are provided in the cover 4.

In accordance with the present invention, the piston assembly 10 is comprised of a cup member 11 of generally U-shaped cross section made of thin-walled metallic material which can be formed by a drawing process to include a generally cylindrical body section $11^a$ conforming closely to the bore 9 of the cylinder 1 and an end wall $11^b$ closing one axial end of the body section $11^a$ and facing or confronting, in this instance, the cover 4. The piston assembly further includes a pair of sleeve members 12, $12^a$ arranged axially next to one another and nested in the bore of the cup 11 which are also made of a thin-walled metal which is easily formed by a deep drawing process. The piston assembly is relatively easy to assemble simply by inserting the sleeve members 12, $12^a$ in the bore of the cup 11 and thereafter, bending the open rim 13 radially inwardly to secure the sleeve members 12, $12^a$ in side by side array in the manner shown in FIG. 1.

The piston assembly has a cam follower operatively associated with a cam surface 16 of the cam disc 7 so that during rotary movement of the drive shaft 6 and the cam disc 7, the cam surface 16 of the cam disc 7 which may be of serpentine configuration moves the piston assembly axially in the bore 9 of the cylinder back and forth and in this manner changes the volume of the stroke space 19 of the piston chamber $1^a$ located between the front surface 18 of the piston 10 and the cover 4. The cam follower in the present instance is formed by confronting axially spaced tabs 14, $14^a$ in each of the sleeve members 12, $12^a$ which form an axial gap 15 within which the edge of the cam surfaces 16 engages. In the present instance, each of the sleeve members 12, $12^a$ has two diametrically opposed tabs 14, $14^a$ By this arrangement, during the upstroke or suction stroke of the piston 10, a fluid medium being pumped is drawn in through the intake valve 2 is then compressed on the subsequent downward or discharge stroke of the piston 10 and expelled when the outlet valve 3 is open. Depending on the construction of the cam disc 7, one or more cycles of the piston 10 can be effected for each revolution of the drive shaft 6.

Figure 3:
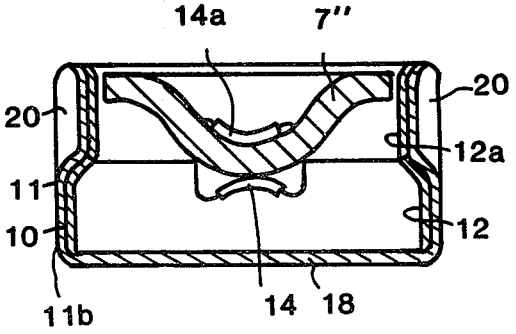
FIG. 3 is a longitudinal sectional view through the piston and the cam disc of a slightly modified embodiment.

In accordance with another feature of the present invention, means is provided preventing rotation of the piston 10 along with the cam disc 7 upon rotation of the drive shaft 6. To this end the piston 10 is formed adjacent its inner free terminal end with a pair of diametrically opposed axially running recesses 20 which may be formed by embossing or the like and the bore 9 of the cylinder is provided over a part of its length with diametrically opposed axially running complementary recesses 21, the recesses 20, 21 forming a channel or pocket 23 for balls 22 which engage in the channel. The channel 23 is of a given axial length to permit full stroke of the piston, and of course, the engagement of the balls in the channel formed by the complementary recesses locks the piston against the rotational movement in the bore 9 of the cylindrical portion of the housing 1. The cam surfaces 16 of the cam disc 7 are typically machined. However, they may be made without machining by stamping or the like from a flat disc. The tabs 14 therefore, are preferably curved in a peripheral direction and in this manner form wedge shaped gaps which draw in lubricant to the contact zone between the tabs and the cam surfaces and thereby reduce friction and wear. (See FIG. 3)

Figure 4:
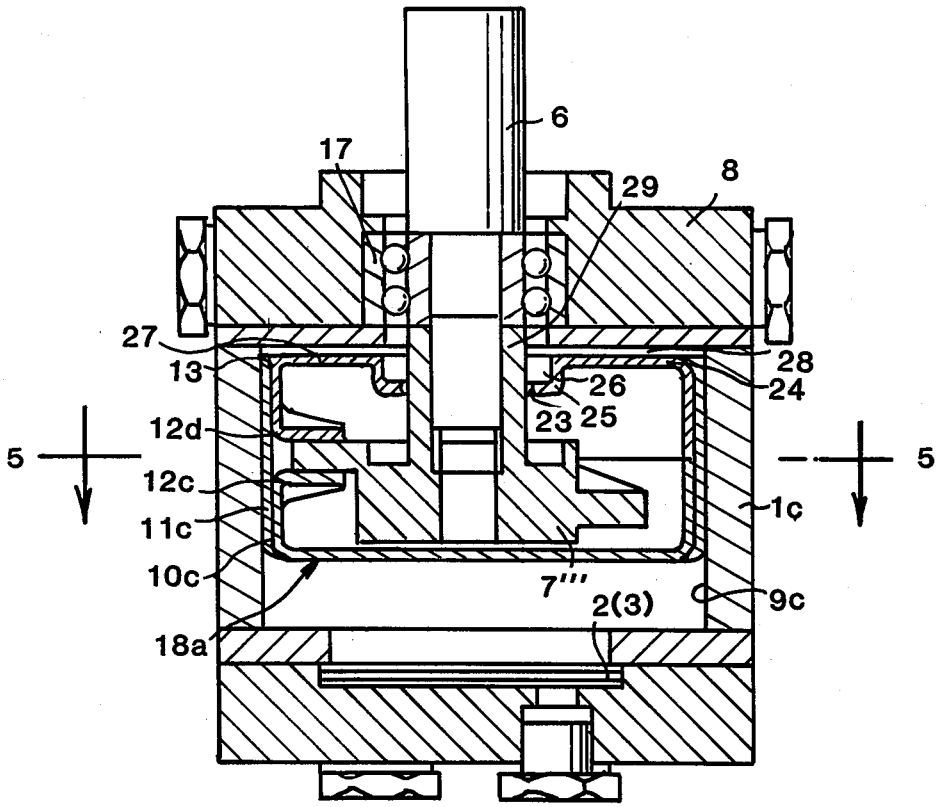
FIG. 4 is a longitudinal sectional view similar to FIG. 1 taken on lines 4—4 of FIG. 5 showing a double acting piston pump.
Figure 5:
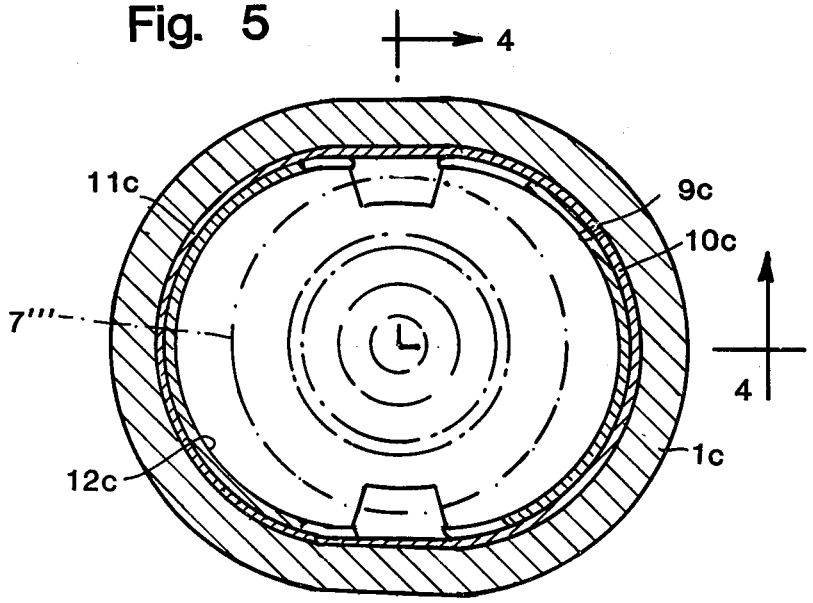
FIG. 5 is a sectional view taken on lines 5—5 of FIG. 4.

There is illustrated in FIGS. 4 and 5 another embodiment of pump assembly in accordance with the present invention. The pump assembly illustrated is a double acting piston pump. The drive system including the drive shaft and cam are similar to that described previously. However, in this instance, inlet and outlet valves are provided in both covers 4 and 8 at opposite axial ends of the cylindrical body portion of the housing. The piston $10^c$ is also in this instance made of thin-walled metal which can be easily formed by a deep drawing process. In the present instance, however, the piston assembly $10^c$ and the bore $9^c$ of the cylindrical body portion $1^c$ of the housing are of a noncircular cross section, for example, an elliptical shape to thereby prevent rotation of the piston $10^c$ in the bore $9^c$.

In accordance with this embodiment of the invention, the piston assembly $10^c$ consists of an elongated generally cylindrical hollow sleeve $11^c$ which is open at both ends and two cup members $12^c$, $12^d$ are arranged axially next to each other in the bore of the sleeve $11^c$. One of the cup members $12^c$ is closed off at one side and forms the front surface $18^a$ of the piston $10^c$ while the other cup member $12^d$ arranged on the side of the drive shaft 6 for the cam disc 7 has a bottom closure wall 24 provided with an opening 23 for the drive shaft 6. A seal 26 is located in a groove formed by the offset inner edge of the cup $12^d$. The axial end face or front surface 27 of the cup $12^d$ together with the cover 8 define an additional stroke volume 28. Additionally, in the present instance, the cam disc 7 has an elongated hub portion $7^a$ formed integrally therewith, the axial end 29 of which forms an annular shoulder facing in the direction of the bearing 17. The outer seal 26 snugly embraces and glides on the outer peripheral surface of the annular shoulder 29. Compared to a single stroke arrangement, almost double the amount of medium to be conveyed can be forwarded at one revolution of the cam or the stroke can be substantially reduced for the same capacity.

While particular embodiments of the present invention have been illustrated and described herein, it is not intended to limit the invention and changes and modifications may be made therein within the scope of the following claims.

Figure 1A:
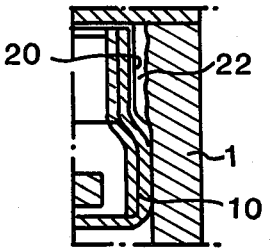
FIG. 1A is a fragmentary sectional view showing a modification of the anti-piston rotation means shown in FIG. 1.

For example, the piston anti-rotation means may comprise an axially extending radially inwardly directed projection 22' on the bore of the housing 1' which engages in a complementary recess 20' formed in the piston assembly as shown in FIG. 1*a*.

Figure 1B:
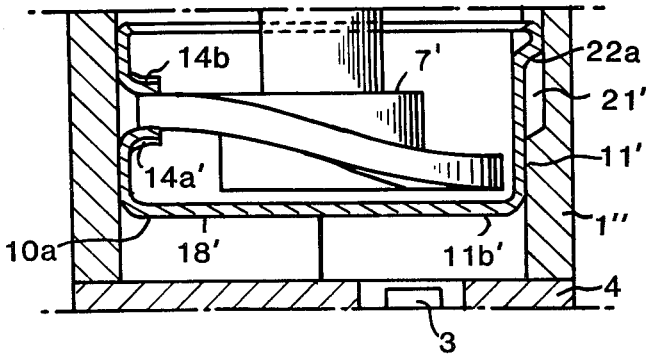
FIG. 1B is a fragmentary longitudinal sectional view similar to FIG. 1 showing a modified piston and another means for preventing piston rotation.

Further, the piston assembly may comprise a single one piece cup member 10A of generally U-shaped cross section made of a thin-walled metallic material formed by a drawing process to include a generally cylindrical body section $11^b$ conforming closely to the bore of the cylinder 1'' and an end wall 18' closing one end of the body section. In this instance, the tabs $14^a$ and $14^b$ defining the cam follower may be formed integrally in the side wall of the piston. Additionally, the piston anti-rotation means may comprise a projection 22A extending radially outwardly from the cylindrical body section which engages in an axial groove 21' in the bore of the housing 1'' (see FIG. 1*b*).

What is claimed is:

1. A piston pump assembly comprising a housing, a single unitary piston member mounted for axial movement in a bore of the housing forming a piston chamber, and arranged coaxially relative to a drive shaft, said piston comprising a thin-walled member of generally cup-shaped configuration, cam means associated with said drive shaft disposed in the bore of said cup-shaped piston and cam follower means associated with said piston operatively connected to said cam means whereby rotation of said shaft effects through said cam and cam follower means axial back-and-forth movement of said piston in said housing bore, said piston including a hollow tubular body section and a pair of thin-walled sleeves axially arranged next to each other in the bore of the body section and wherein each of said sleeves has a radially inwardly directed tab formed integrally with the sleeve, said tabs being located at confronting axial ends of the sleeves and being spaced to embrace said cam means and each tab being of arcuate shape in a peripheral direction and defining the cam follower means.

2. A piston pump assembly as claimed in claim 1 wherein said body section is open at both axial ends and at least one of said sleeves is constructed so that it is closed at one axial end.

3. A piston pump assembly as claimed in claim 1 wherein each of said sleeves has at least two diametrically opposed tabs which are radially inwardly directed.

4. A piston pump assembly as claimed in claim 1 wherein said tabs and/or said cam means are coated with a layer of a low friction material.

5. A piston pump assembly as claimed in claim 1 including means preventing rotation of said piston member in said piston chamber.

6. A piston pump assembly as claimed in claim 5 wherein said means preventing rotation comprises at least one radial projection on the piston member engageable in a recess in the housing bore.

7. A piston pump assembly as claimed in claim 5 wherein said means comprises a projection in the housing bore engageable in a recess in said piston member.

8. A piston pump assembly as claimed in claim 1 wherein the outer peripheral surface of the piston and the bore of the piston chamber are each provided with at least one axially directed recess forming a channel and including rolling elements engageable in said channel to secure the piston against rotation relative to the piston chamber.

9. A piston pump assembly as claimed in claim 1 wherein the cross section of the piston and the cross section of the piston chamber are of non-circular cross section.

10. A piston pump assembly as claimed in claim 1 wherein said piston cross section and the piston chamber cross section are elliptical.

11. A piston pump assembly as claimed in claim 1 wherein the peripheral edge of said piston facing said drive shaft is radially inwardly directed to a point adjacent the drive shaft.

12. A piston pump assembly as claimed in claim 2 wherein said sleeve arranged adjacent the drive shaft of the cam disc has a bottom closure provided with an opening for the drive shaft of the cam disc.

13. A piston pump assembly as claimed in claim 12 including seal means for the gap between the inside edge of a rolled over rim portion of said sleeve and the opening and the outside annular surface of the drive shaft.

* * * * *